US006997411B2

(12) United States Patent
Kewin

(10) Patent No.: US 6,997,411 B2
(45) Date of Patent: Feb. 14, 2006

(54) TUBULAR CORE ASSEMBLIES FOR ROLLS OF PAPER OR OTHER SHEET MATERIAL

(76) Inventor: Daniel D. Kewin, 16 Dogwood Drive, Brantford, ON (CA) N3R 1R3

( * ) Notice: Subject to any disclaimer, the term of this patent is extended or adjusted under 35 U.S.C. 154(b) by 0 days.

(21) Appl. No.: 10/847,570

(22) Filed: May 18, 2004

(65) Prior Publication Data

US 2004/0245368 A1 Dec. 9, 2004

Related U.S. Application Data

(60) Provisional application No. 60/473,878, filed on May 29, 2003.

(51) Int. Cl.
*B65H 75/10* (2006.01)

(52) U.S. Cl. ..... 242/613.5

(58) Field of Classification Search ..... 242/613.5, 242/611.2, 609, 609.1, 609.3
See application file for complete search history.

(56) References Cited

U.S. PATENT DOCUMENTS 1,180,955 A * 4/1916 Stuck ..... 242/609
3,713,601 A * 1/1973 Buhrman et al. ..... 242/611.2
5,236,141 A * 8/1993 Kewin ..... 242/611.2
5,595,356 A * 1/1997 Kewin ..... 242/613.5
5,615,845 A * 4/1997 Kewin ..... 242/613.5
5,725,178 A * 3/1998 Kewin ..... 242/613.5
5,829,713 A * 11/1998 Kewin ..... 242/613.5
6,193,186 B1 * 2/2001 Kewin ..... 242/613.5

* cited by examiner

*Primary Examiner*—Kathy Matecki
*Assistant Examiner*—Sang Kim

(57) ABSTRACT

A tubular core assembly for a roll of paper or other sheet material has a hollow cylindrical core member of metal or plastic material, the core member having at least one lug projecting radially inwardly from an inner surface thereof adjacent to each end of the core member. Each lug is longitudinally spaced from the respective adjacent end of the core member, and an annular plastic end member is located within each opposite end portion of the core member and is a friction fit therein. Each end member has a notch at its longitudinally inner end receiving the lug adjacent to the respective end of the core member to facilitate transmission of torque and axial chuck pressure from the end members to the core member.

10 Claims, 1 Drawing Sheet

TUBULAR CORE ASSEMBLIES FOR ROLLS OF PAPER OR OTHER SHEET MATERIAL

RELATED APPLICATION

This application claims priority from U.S. Provisional Patent Application No. 60/473,878 filed on May 29, 2003.

FIELD OF THE INVENTION

This invention relates to tubular core assemblies for rolls of paper or other sheet material.

BACKGROUND OF THE INVENTION

For various reasons well known to persons skilled in the art, known core members of paperboard material are not particularly satisfactory for use with modern day paper making equipment and printing presses. Such known core members tend to be weak and unstable and present problems because of external surface discontinuities produced by metal end reinforcements.

Tubular core assemblies which have a hollow cylindrical core member of paperboard material and an annular end member of plastic material within each opposite end portion of the core member are known, see for example U.S. Pat. No. 6,193,186 issued Feb. 27, 2001, the contents of which are hereby incorporated herein by reference.

It has been realized that it would be advantageous to make the core member of harder and more stable material such as metal or plastic material. However, merely making the core member of known tubular core assemblies of metal or plastic material instead of paperboard material does not provide a satisfactory solution, because such a metal or plastic core member would be unduly heavy since its wall thickness is dictated by the design thickness of the paperboard tubular core assemblies in common usage in mill gang winding operations.

It is therefore an object of the present invention to provide a tubular core assembly with a metal or plastic core member and appropriate end members which does not suffer from the problem mentioned above.

SUMMARY OF THE INVENTION

According to the invention, a tubular core assembly for a roll of paper or other sheet material has a hollow cylindrical core member of metal or plastic material, the core member having at least one lug projecting radially inwardly from an inner surface thereof adjacent to each end of the core member, each lug being longitudinally spaced from the respective adjacent end of the core member. An annular plastic end member is located within each opposite end portion of the core member and is a friction fit therein, each end member having a notch at its longitudinally inner end receiving the lug adjacent to the respective end of the core member to facilitate transmission of torque and axial chuck pressure from the end members to the core member.

The radial and axial thickness and width of such a lug may now be primarily dictated by the optimal lug/notch area interface required, independently of either end member or core member thickness, which may consequently be relatively thin and hence lightweight. Also, a tubular core assembly in accordance with the invention is satisfactorily stable and does not have external discontinuities. Also, since the end members can be easily replaced, the core member in accordance with the present invention may have a substantially longer life. Further, each end member may have a said notch at its opposite end to enable the end member to be reversed and provide the tubular core assembly with a longer life.

The core member may have an outer diameter in the range of from about 3.5 to about 7 inches, an inner diameter in the range from about 3 to about 6.75 inches and a wall thickness in the range of from about 0.05 to about 0.3 inches.

Each lug may be solid and project inwardly from the inner surface of the core member for a distance in the range of from about 0.25 to about 0.75 inches, and have a circumferential width in the range from about 0.25 to about 4 inches, and an axial length in the range from about 0.25 to about 6 inches.

Each end member may have an internal diameter in the range of from about 2.5 to about 6 inches, an outer diameter in the range of from about 3 to about 6.75 inches and a wall thickness in the range of from about 0.1 to about 1.5 inches and a length in the range of from about 0.5 to about 6 inches.

DESCRIPTION OF THE DRAWINGS

One embodiment of the invention will now be described, by way of example, with reference to the accompanying drawings, of which.

DESCRIPTION OF THE PREFERRED EMBODIMENT

Figures 1, 2:
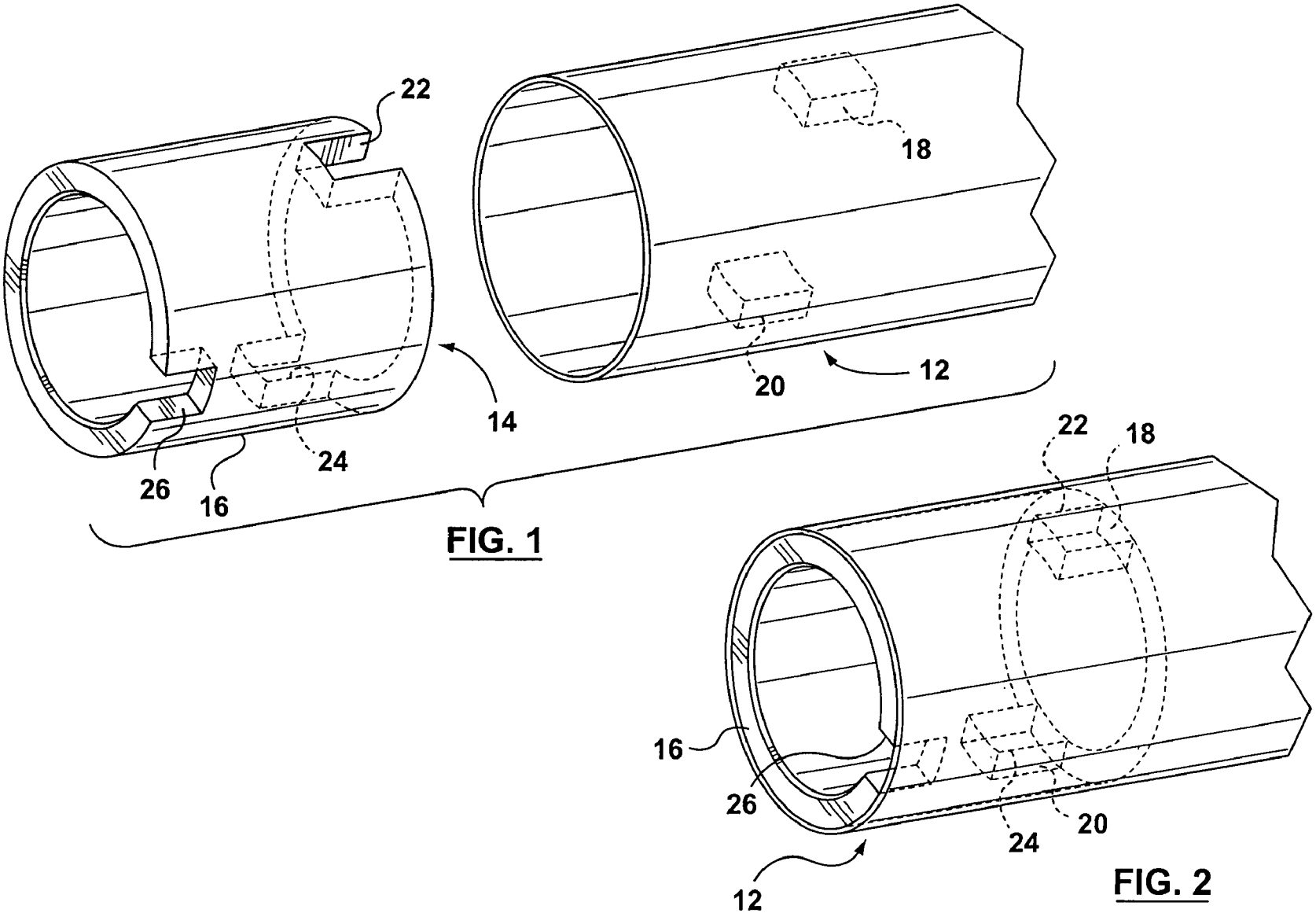
FIG. 1 is an exploded view of one end portion of a tubular core assembly in accordance with one embodiment of the invention.
FIG. 2 is a perspective view of the tubular core assembly of FIG. 1 in an assembled condition.

Referring to the drawings, FIGS. 1 and 2 show one end portion of a tubular core assembly for a paper roll which comprises a hollow cylindrical core member 12 of metal or plastic material, and an annular end member 14 of plastic material with a sleeve portion 16 within each opposite end portion of the core member 12. The core member 12 may be of metal such as Schedule 10 iron pipe or suitable polymeric material such as A.B.S. or polycarbonate. Each end member 14 may be of similar plastic material.

The sleeve portion 16 of each end member 14 has an outer annular surface which is a friction fit in a respective end portion of the core member 12. The inner surface of each end member 14 adjacent to the respective end of the core member 12 is shaped to receive a chuck (not shown) in known manner.

The core member 12 has a pair of diametrically opposite metal or plastic lugs 18, 20 of rectangular section projecting radially inwardly from the inner surface thereof adjacent to each end of the core member 12, each pair of lugs 18, 20 being longitudinally spaced from the adjacent respective end of the core member 12. The lugs 18, 19 may be integral with the core member 12 or may be secured thereto in any suitable manner, for example by welding. The lugs 18, 20 may be solid or hollow, for example tubular.

The sleeve portion 16 of each plastic end member 14 is a friction fit in a respective end portion of the core member 12. Each end member 14 has a pair of diametrically opposite notches 22, 24 of rectangular section at its longitudinally inner end receiving the lugs 18, 20 adjacent to the respective end of the core member 12 to facilitate transmission of torque and axial chuck pressure from the end members 14 to the core member 12.

The outer end of each end member 14 has a notch 26 to receive a key on a chuck stub shaft. The notch 26 may have the same dimensions as each of the notches 22, 24 to enable the end member to be reversed and thus provide increased life for the tubular core assembly. Advantageously, two diametrically opposite notches 26 may be provided for this purpose.

In one specific example of the invention, the core member has an outer diameter of 4 inches, an inner diameter of 3.5 inches and a wall thickness of 0.25 inches. Each lug 18, 20 projects inwardly from the inner surface of the core member 12 for 0.275 inches, and has a circumferential width of 1.5 inches and an axial length of 2 inches. Each end member has an internal diameter of 3 inches, an outer diameter of 3.5 inches, a wall thickness of 0.4 inches and a length of 3 inches.

The advantages and other embodiments of the invention will now be readily apparent to a person skilled in the art from the foregoing description. The scope of the invention is defined in the appended claims.

What is claimed is:

1. A tubular core assembly for a roll of paper or other sheet material having a hollow cylindrical core member of metal or plastic material, the core member having at least one lug projecting radially inwardly from an inner surface thereof adjacent to each end of the core member, each lug being longitudinally spaced from the respective adjacent end of the core member, and an annular plastic end member located within each opposite end portion of the core member and being a friction fit therein, each end member having a notch at its longitudinally inner end receiving the lug adjacent to the respective end of the core member to facilitate transmission of torque and axial chuck pressure from the end members to the core member.

2. A tubular core assembly according to claim 1 wherein the core member has an outer diameter in the range of from about 3.5 to about 7 inches, an inner diameter in the range from about 3 to about 6.75 inches and a wall thickness in the range of from about 0.05 to about 0.3 inches.

3. A tubular core assembly according to claim 2 wherein each lug is solid and projects inwardly from the inner surface of the core member for a diameter in the range of from about 0.25 to about 0.75 inches and has a circumferential width in the range of from about 0.25 to about 4 inches and an axial length in the range of from about 0.25 to about 6 inches.

4. A tubular core assembly according to claim 1 wherein each end member has an internal diameter in the range of from about 2.5 to about 6 inches, an outer diameter in the range of from about 3 to about 6.75 inches and a wall thickness in the rage of from about 0.1 to about 1.5 inches and a length in the range of from about 0.5 to about 6 inches.

5. A tubular core assembly according to claim 1 wherein the core member has an outer diameter in the range of from about 3.5 to about 7 inches, an inner diameter in the range from about 3 to about 6.75 inches and a wall thickness in the range of from about 0.05 to about 0.3 inches, each lug being solid and projecting inwardly from the inner surface of the core member for a diameter in the range of from about 0.25 to about 0.75 inches and has a circumferential width in the range of from about 0.25 to about 4 inches and an axial length in the range of from about 0.25 to about 6 inches.

6. A tubular core assembly according to claim 1 wherein the core member has an outer diameter in the range of from about 3.5 to about 7 inches, an inner diameter in the range from about 3 to about 6.75 inches and a wall thickness in the range of from about 0.05 to about 0.3 inches, each end member having an internal diameter in the range of from about 2.5 to about 6 inches, an outer diameter in the range of from about 3 to about 6.75 inches and a wall thickness in the rage of from about 0.1 to about 1.5 inches and a length in the range of from about 0.5 to about 6 inches.

7. A tubular core assembly according to claim 1 wherein the core member has an outer diameter in the range of from about 3.5 to about 7 inches, an inner diameter in the range from about 3 to about 6.75 inches and a wall thickness in the range of from about 0.05 to about 0.3 inches, each lug being solid and projecting inwardly from the inner surface of the core member for a diameter in the range of from about 0.25 to about 0.75 inches and has a circumferential width in the range of from about 0.25 to about 4 inches and an axial length in the range of from about 0.25 to about 6 inches and each end member has an internal diameter in the range of from about 2.5 to about 6 inches, an outer diameter in the range of from about 3 to about 6.75 inches and a wall thickness in the rage of from about 0.1 to about 1.5 inches and a length in the range of from about 0.5 to about 6 inches.

8. A tubular core assembly according to claim 1 wherein each lug is solid and projects inwardly from the inner surface of the core member for a distance in the range of from about 0.25 to about 0.75 inches and has a circumferential width in the range of from about 0.25 to about 4 inches and an axial length in the range of from about 0.25 to about 6 inches and each end member has an internal diameter in the range of from about 2.5 to about 6 inches, an outer diameter in the range of from about 3 to about 6.75 inches and a wall thickness in the range of from about 0.1 to about 1.5 inches and a length in the range of from about 0.5 to about 6 inches.

9. A tubular core assembly according to claim 1 wherein each end member also has a notch at its longitudinally outer end with the same dimensions as the notch at its longitudinally inner end.

10. A tubular core assembly according to claim 1 where in the core member has a pair of diametrically spaced said lugs adjacent each end of the core member, and each end member has a pair of diametrically spaced said notches at its longitudinally inner end respectively receiving said lugs.

* * * * *